US009323195B2

(12) United States Patent
Matsumoto

(10) Patent No.: US 9,323,195 B2
(45) Date of Patent: Apr. 26, 2016

(54) FIXING DEVICE AND IMAGE FORMING APPARATUS

(71) Applicant: Oki Data Corporation, Tokyo (JP)

(72) Inventor: Keigo Matsumoto, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/682,669

(22) Filed: Apr. 9, 2015

(65) Prior Publication Data

US 2015/0309455 A1 Oct. 29, 2015

(30) Foreign Application Priority Data

Apr. 25, 2014 (JP) ..... 2014-091180
Apr. 28, 2014 (JP) ..... 2014-092204

(51) Int. Cl.
*G03G 15/20* (2006.01)

(52) U.S. Cl.
CPC ..... *G03G 15/2085* (2013.01); *G03G 15/2028* (2013.01)

(58) Field of Classification Search
CPC ..... G03G 15/2028; G03G 15/2085; G03G 2215/00573
See application file for complete search history.

(56) References Cited

U.S. PATENT DOCUMENTS

2005/0013638 A1* 1/2005 Fukuda et al. ..... 399/323
2005/0084302 A1* 4/2005 Masuda et al. ..... 399/322
2006/0177249 A1* 8/2006 Aratachi et al. ..... 399/323
2007/0048036 A1* 3/2007 Kanematsu et al. ..... 399/323
2007/0280752 A1* 12/2007 Uchida ..... 399/323
2008/0080909 A1* 4/2008 Yamada ..... 399/323
2011/0227273 A1* 9/2011 Osaki ..... 271/10.09
2012/0195652 A1* 8/2012 Takahashi et al. ..... 399/323
2013/0336686 A1* 12/2013 Yamamoto ..... 399/323
2015/0030358 A1* 1/2015 Yamakawa ..... 399/323

FOREIGN PATENT DOCUMENTS

JP 2007-183666 A 7/2007
JP 2011-197133 A 10/2011

* cited by examiner

*Primary Examiner* — David Gray
*Assistant Examiner* — Carla Therrien
(74) *Attorney, Agent, or Firm* — Rabin & Berdo, P.C.

(57) ABSTRACT

A fixing device includes: a unit that includes a fixing member and a pressure member contacting the fixing member to form a nip, and heats a medium with a toner image while conveying it with it nipped in the nip, fixing the toner image; a separating member that separates the medium from the fixing member; and a holder holding the separating member. The separating member includes: a separating guide portion that is disposed downstream of the nip in a conveying direction of the medium and faces the fixing member along a width direction of the fixing member, extends along the conveying direction, and separates the medium from the fixing member; and an extending portion that extends from a downstream edge in the conveying direction of the separating guide portion, and is bent with respect to the separating guide portion to separate from the medium downstream in the conveying direction.

20 Claims, 12 Drawing Sheets

FIXING DEVICE AND IMAGE FORMING APPARATUS

BACKGROUND OF THE INVENTION

1. Field of the Invention

The present invention relates to a fixing device and an image forming apparatus.

2. Description of the Related Art

Japanese Patent Application Publication No. 2007-183666 discloses a fixing device that includes a heating roller and a backup roller, and heats and presses toner transferred on a recording medium to fix the toner onto the recording medium. The fixing device further includes a separating member for separating the recording medium from the heating roller. The separating member is formed of a thin rectangular metal plate.

Japanese Patent Application Publication No. 2011-197133 discloses a fixing device including: a fixing unit that includes a heat roller and a pressure roller, and heats and fuses a toner image transferred on a sheet of paper to fix the toner image onto the sheet; and a separating unit for separating the sheet from the heat roller. The separating unit includes a separating claw pressed against the heat roller and a guide roller for guiding the sheet separated by the separating claw downstream.

SUMMARY OF THE INVENTION

An aspect of the present invention is intended to improve print quality.

According to an aspect of the present invention, there is provided a fixing device including: a fixing unit that includes a rotating fixing member and a pressure member making contact with the fixing member to form a nip portion between the fixing member and the pressure member, and heats a recording medium on which a toner image is formed while conveying the recording medium with the recording medium nipped in the nip portion, thereby fixing the toner image to the recording medium; a plate-shaped separating member that separates, from the fixing member, the recording medium discharged from the nip portion; and a holder that holds the separating member. The separating member includes: a separating guide portion that is disposed downstream of the nip portion in a conveying direction in which the recording medium is conveyed so as to face the fixing member along a width direction of the fixing member perpendicular to the conveying direction, extends in a guide direction along the conveying direction, and separates the recording medium from the fixing member to guide the recording medium; and an extending portion that extends from a downstream edge in the conveying direction of the separating guide portion, and is bent with respect to the separating guide portion so as to separate from the recording medium downstream in the conveying direction.

According to another aspect of the present invention, there is provided a fixing device including: a fixing unit that includes a rotating fixing member and a pressure member making contact with the fixing member to form a nip portion between the fixing member and the pressure member, and heats a recording medium on which a toner image is formed while conveying the recording medium with the recording medium nipped in the nip portion, thereby fixing the toner image to the recording medium; a pair of conveying rollers that is disposed downstream of the fixing unit in a conveying direction in which the recording medium is conveyed, and conveys the recording medium discharged from the fixing unit; and a guide roller that is disposed between the fixing unit and the pair of conveying rollers in the conveying direction, and guides the recording medium discharged from the fixing unit while rotating along the conveying direction. In a width direction of the fixing member perpendicular to the conveying direction, the guide roller extends over an area in which a widest recording medium that can be conveyed by the fixing device is conveyed.

According to another aspect of the present invention, there is provided an image forming apparatus including any one of the above fixing devices and an image forming section that forms the toner image on the recording medium.

These aspects improve print quality.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

An embodiment of the present invention will now be described with reference to the attached drawings.

<Configuration of Image Forming Apparatus>

Figure 1:
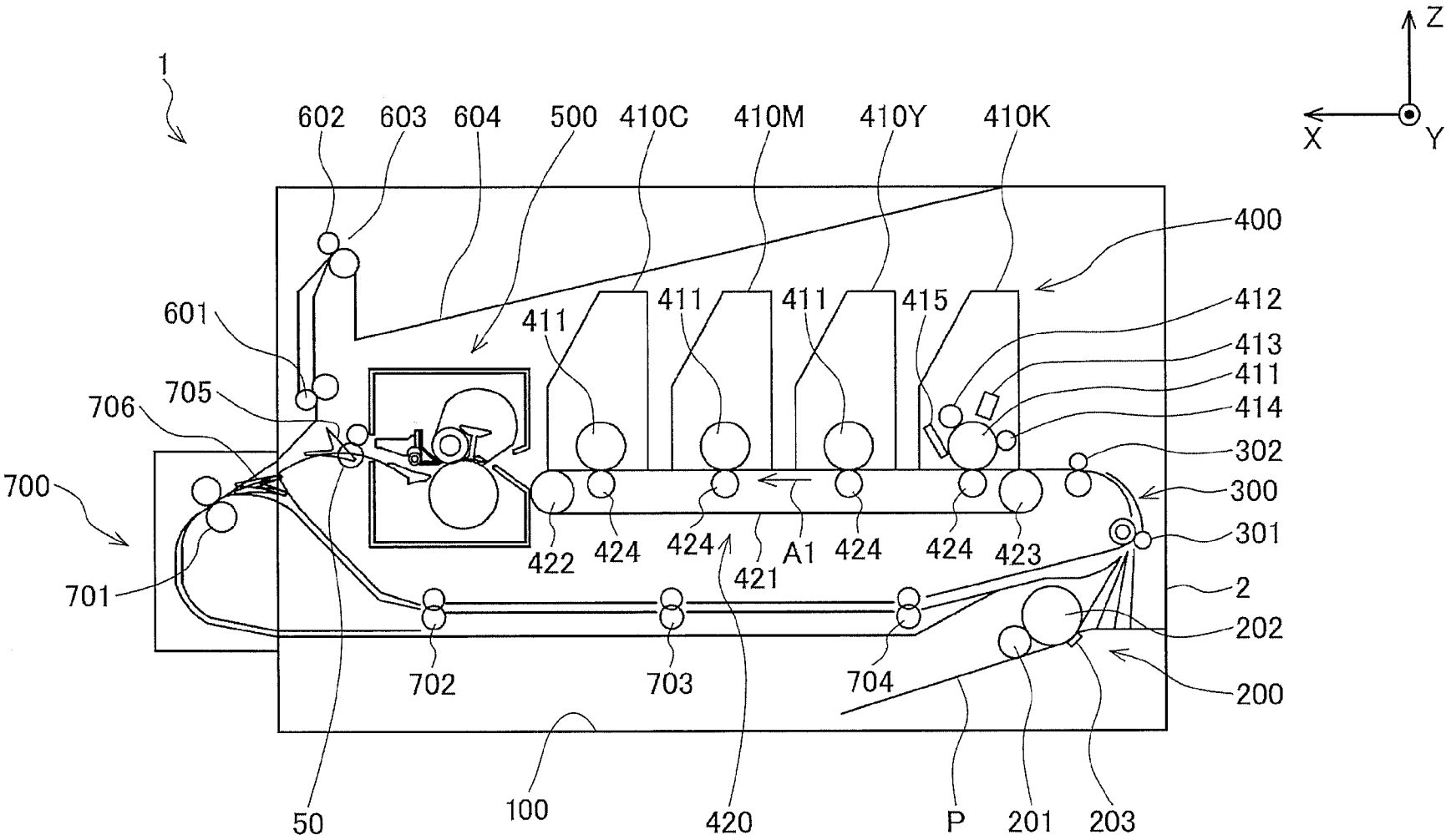
FIG. 1 is a schematic view illustrating the configuration of an image forming apparatus having a fixing device in an embodiment.

FIG. 1 is a schematic view illustrating the configuration of an image forming apparatus 1 having a fixing device 500 in this embodiment. The image forming apparatus 1 forms an image by fixing a toner image as a developer image formed on a recording medium by means of the fixing device 500. Specifically, the image forming apparatus 1 is an electrophotographic printing apparatus, and in this example, a color printer.

The image forming apparatus 1 includes a sheet tray 100, a sheet feeding section 200, a sheet conveying section 300, an image forming section 400, and the fixing device 500.

The sheet tray 100 stores sheets of paper (referred to below simply as sheets) P as recording media in a stacked manner. The sheet tray 100 is configured to raise the sheets P stored therein to a predetermined height.

The sheet feeding section 200 is disposed on a sheet feeding side of the sheet tray 100 and feeds one by one the sheets P stored in the sheet tray 100. The sheet feeding section 200 includes a pickup roller 201, a feed roller 202, and a separating piece 203. The pickup roller 201 is disposed to make pressure contact with the sheets P raised to the predetermined height, and feeds the sheets P. The feed roller 202 and separating piece 203 separate and feed the sheets P fed by the pickup roller 201 one by one.

The sheet conveying section 300 conveys the sheet P fed by the sheet feeding section 200 to the image forming section 400. The sheet conveying section 300 includes pairs of conveying rollers 301 and 302 for conveying the fed sheet P.

The image forming section 400 forms a toner image on the sheet P conveyed from the sheet conveying section 300. The image forming section 400 includes four toner image forming units 410K, 410Y, 410M, and 410C, and a transfer unit 420. The toner image forming units 410K, 410Y, 410M, and 410C form toner images of black (K), yellow (Y), magenta (M), and cyan (C), respectively. The toner image forming units 410K, 410Y, 410M, and 410C are arranged in tandem along a direction in which the sheet is conveyed, and are detachably mounted to an apparatus main body 2. The transfer unit 420 transfers, onto the sheet P, the toner images of the respective colors formed by the image forming units 410K, 410Y, 410M, and 410C.

The toner image forming unit 410K includes a photosensitive drum 411 as an image carrier for carrying a toner image, a charging roller 412 as a charging device for charging a surface of the photosensitive drum 411, an optical head 413 as a latent image forming device or an exposure device for forming an electrostatic latent image on the charged surface of the photosensitive drum 411, a developing roller 414 as a developing device for developing the electrostatic latent image with toner as developer to form a toner image on the photosensitive drum 411, and a cleaning blade 415 as a cleaning device for cleaning the surface of the photosensitive drum 411. The toner image forming units 410Y, 410M, and 410C have the same configuration as the toner image forming unit 410K except for colors of toner used therein, and thus their description will be omitted.

The transfer unit 420 includes a transfer belt 421, a drive roller 422, a tension roller 423, and four transfer rollers 424. The transfer belt 421 is an endless belt that electrostatically holds the sheet P and conveys it in the direction indicated by arrow A1 in FIG. 1. The drive roller 422 drives the transfer belt 421. The tension roller 423 supports and stretches the transfer belt 421 together with the drive roller 422. The four transfer rollers 424 are disposed facing the four photosensitive drums 411 with the transfer belt 421 therebetween. Each of the transfer rollers 424 transfers the toner image on the corresponding photosensitive drum 411 onto an upper surface of the sheet P by coulomb force. The transfer belt 421 conveys, to the fixing device 500, the sheet P onto which the toner image is transferred.

The fixing device 500 fixes the toner image formed on the sheet P by the image forming section 400 to the sheet P with heat and pressure. The fixing device 500 will be detailed later.

Downstream of the fixing device 500, there are provided pairs of discharge rollers 601 and 602 for conveying the sheet P delivered from the fixing device 500 to discharge the sheet P from an outlet 603, and a stacker 604 for stacking the sheet P discharged from the outlet 603. Further, for two-sided printing, an inverting section 700 is provided. The inverting section 700 inverts the sheet P delivered from the fixing device 500 and conveys it to the sheet conveying section 300. The inverting section 700 includes pairs of conveying rollers 701 to 704 for conveying the sheet P, and conveying path switching guides 705 and 706 for switching a conveying path of the sheet P.

Figure 2:
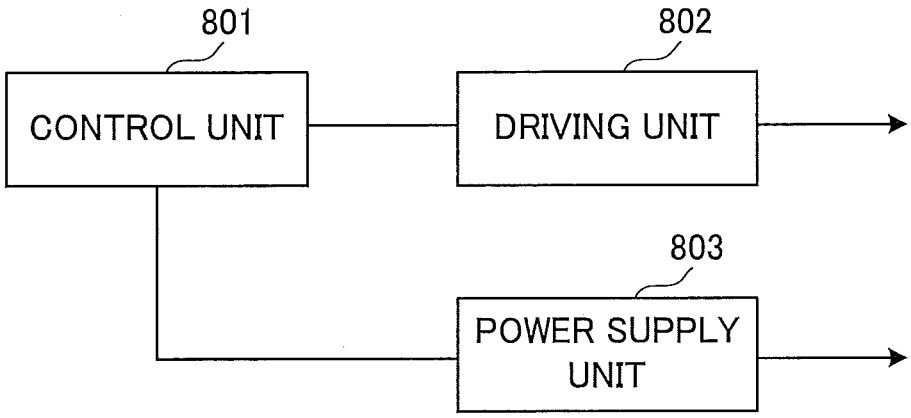
FIG. 2 is a block diagram illustrating the configuration of the image forming apparatus in the embodiment.

As illustrated in FIG. 2, the image forming apparatus 1 further includes a control unit 801, a driving unit 802, and a power supply unit 803. The control unit 801 includes, for example, a central processing unit (CPU), and controls the operation of the image forming apparatus 1. The driving unit 802 includes, for example, a motor, and supplies driving force to respective parts, such as the fixing device 500, in the image forming apparatus 1 in accordance with an instruction from the control unit 801. The power supply unit 803 supplies electric power or voltage to respective parts, such as the fixing device 500, in the image forming apparatus 1 in accordance with an instruction from the control unit 801.

<Configuration of Fixing Device>

The fixing device 500 will now be described.

Figure 3:
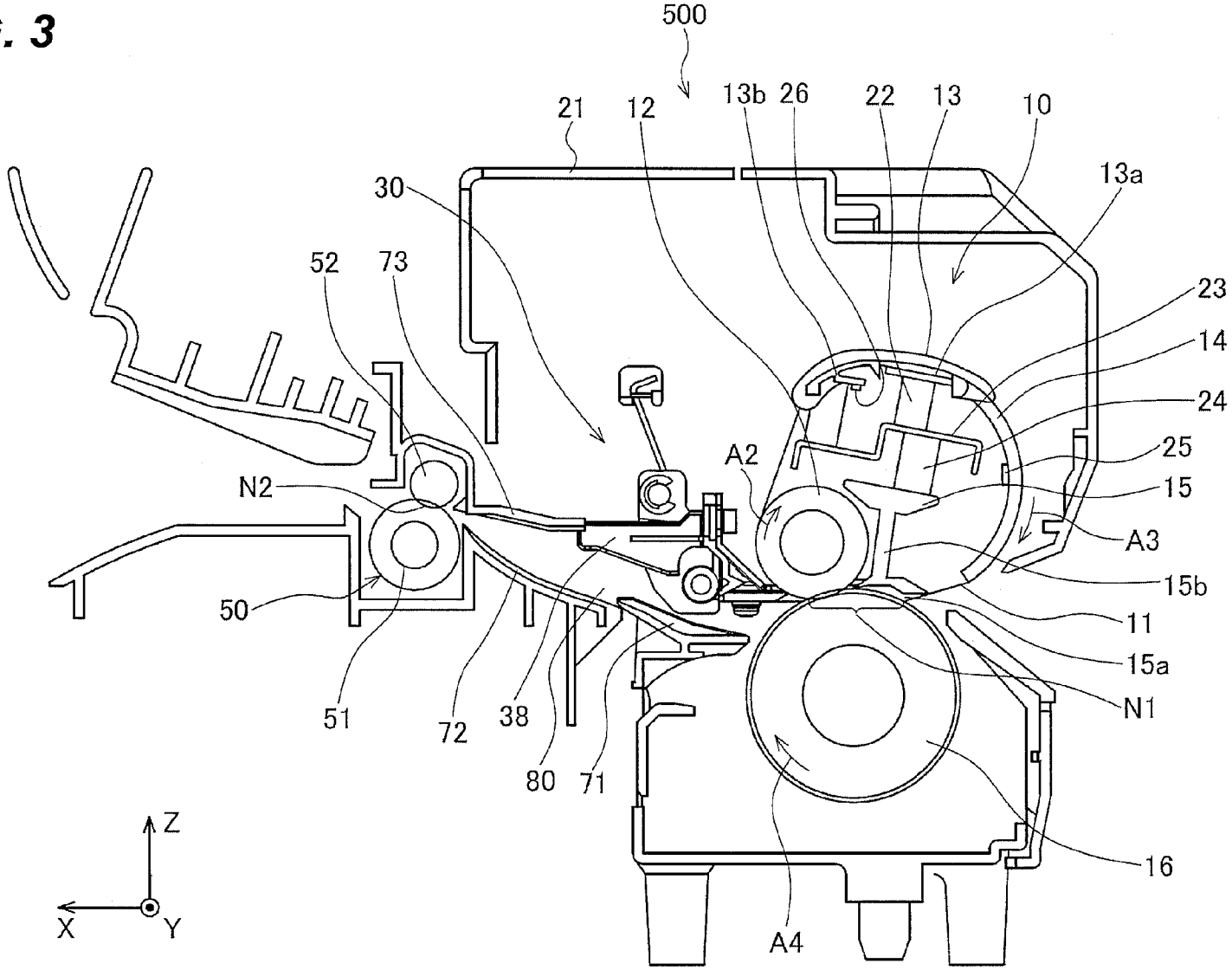
FIG. 3 is a sectional view illustrating the configuration of the fixing device in the embodiment.

FIG. 3 is a sectional view illustrating the configuration of the fixing device 500 in this embodiment. In FIG. 3, the fixing device 500 includes a fixing unit 10, a separating unit 30, a pair of conveying rollers 50, and sheet guides 71, 72, and 73.

The fixing unit 10 includes a fixing belt 11 as a rotating fixing member and a pressure roller 16 as a pressure member that makes contact with the fixing belt 11 to form a nip portion (or a contact portion) N1. The fixing unit 10 heats a sheet P on which a toner image is formed while conveying the sheet P with the sheet P nipped in the nip portion N1, thereby fixing the toner image to the sheet P. The fixing unit 10 is mounted to a fixing frame 21 fixed to the apparatus main body 2. Hereinafter, a direction in which the sheet P is conveyed by the fixing unit 10 will be referred to as 'the sheet conveying direction'.

In FIG. 3, the fixing unit 10 includes the fixing belt 11, a fixing roller 12, a heating member 13, a belt guide 14, a fixing pad 15, and the pressure roller 16.

The fixing belt 11 is an endless member that heats and fuses the toner image on the sheet P. The fixing belt 11 extends in a width direction (the direction perpendicular to the drawing sheet of FIG. 3) perpendicular to the sheet conveying direction. The width direction of the fixing belt 11 matches a width direction of the sheet P perpendicular to the sheet conveying direction. Hereinafter, a direction parallel to the width direction of the fixing belt 11 will be referred to simply as 'the width direction'. The fixing belt 11 has a fluorine coating on its surface. The fixing roller 12, heating member 13, belt guide 14, and fixing pad 15 are arranged in this order inside the fixing belt 11. Each of the fixing roller 12, heating member 13, belt guide 14, and fixing pad 15 extends in the width direction.

The fixing roller 12 is rotatably supported by the fixing frame 21 and is connected to the driving unit 802 via a gear (not illustrated). The fixing roller 12 is rotated by driving force from the driving unit 802 in a predetermined rotational direction (the direction of arrow A2 in FIG. 3) to rotate the fixing belt 11 in a predetermined rotational direction (the direction of arrow A3 in FIG. 3). The fixing roller 12 has a metal pipe and a silicone sponge layer as an elastic layer formed on the outer periphery of the metal pipe.

The heating member 13 is a member for heating the fixing belt 11. Specifically, the heating member 13 includes a heater 13*a* and a heat transfer member 13*b*. The heater 13*a* is a heat source that receives power supply from the power supply unit 803 to produce heat. The heat transfer member 13*b* transfers the heat from the heater 13*a* to the fixing belt 11. The heating member 13 is pressed against an inner surface of the fixing belt 11 by a spring 22 as an urging member. The spring 22 is disposed between a support 23 fixed to the fixing frame 21 and the heating member 13.

The belt guide 14 is fixed to the fixing frame 21 and makes contact with the inner surface of the fixing belt 11 to guide movement of the fixing belt 11.

The fixing pad 15 is supported by the fixing frame 21 and is urged toward the pressure roller 16 by a spring 24 as an urging member. The spring 24 is disposed between the support 23 and the fixing pad 15. The fixing pad 15 has a rubber contact portion 15*a* in contact with the fixing belt 11 and a metal frame 15*b* supporting the contact portion 15*a*.

The pressure roller 16 extends in the width direction and is disposed facing the fixing roller 12 and fixing pad 15 via the fixing belt 11. The pressure roller 16 is pressed against the fixing roller 12 and fixing pad 15 via the fixing belt 11 by a spring (not illustrated) as an urging member, and forms the nip portion N1 between the pressure roller 16 and the fixing belt 11. The pressure roller 16 is rotatably supported by the fixing frame 21 and rotates in the direction of arrow A4 in FIG. 3 along with the rotation of the fixing roller 12. The pressure roller 16 has a metal pipe and a silicone rubber layer as an elastic layer formed on the outer periphery of the metal pipe.

In addition, the fixing unit 10 includes a temperature detecting member 25 for detecting a temperature of the fixing belt 11 and an overheat prevention member 26 for preventing overheat of the fixing unit 10. The temperature detecting member 25 is, for example, a thermistor and outputs the detection result to the control unit 801. The overheat prevention member 26 is, for example, a thermostat and cuts off the power supply from the power supply unit 803 to the heater 13*a* when a temperature of the heat transfer member 13*b* reaches a predetermined temperature.

The separating unit 30 is disposed downstream of the fixing unit 10 in the sheet conveying direction. The separating unit 30 separates, from the fixing belt 11, the sheet P discharged from the nip portion N1 and guides the sheet P. The separating unit 30 prevents the sheet P from winding around the fixing belt 11.

The pair of conveying rollers 50 is disposed downstream of the separating unit 30 in the sheet conveying direction, and further conveys the sheet P passing through the separating unit 30. Multiple pairs of conveying rollers may be disposed downstream of the fixing unit 10 in the sheet conveying direction. In this case, the pair of conveying rollers 50 is the first (or the closest to the fixing unit 10) of the pairs of conveying rollers, that is, the most upstream of the pairs of conveying rollers. The pair of conveying rollers 50 includes two conveying rollers 51 and 52 that are in contact with each other to form a nip portion (or a contact portion) N2. The two conveying rollers 51 and 52 are rotated by driving force from the driving unit 802, and convey the sheet P while nipping the sheet P in the nip portion N2. From the view point of preventing the occurrence of wrinkles on the sheet P or other reasons, the velocity VE at which the sheet P is conveyed by the pair of conveying rollers 50 is set to be greater than the velocity VF at which the sheet P is conveyed by the fixing unit 10, that is, VE>VF.

The sheet guides 71 to 73 extend in the sheet conveying direction and guide, toward the pair of conveying rollers 50, the sheet P discharged from the fixing unit 10. Each of the sheet guides 71 to 73 includes multiple ribs that are arranged in the width direction and extend in the sheet conveying direction. The sheet guides 71 to 73 are formed of resin. The sheet guide 71 is disposed facing the separating unit 30; the sheet guide 72 is disposed adjacent to and downstream of the sheet guide 71 in the sheet conveying direction; the sheet guide 73 is disposed adjacent to and downstream of the separating unit 30 in the sheet conveying direction.

A sheet conveying path 80 through which the sheet P is conveyed is formed between the separating unit 30 and sheet guide 73 and the sheet guides 71 and 72. The separating unit 30 and sheet guide 73 are disposed above the sheet conveying path 80 and face a printed surface of the sheet P. The sheet guides 71 and 72 are disposed below the sheet conveying path 80. The printed surface of the sheet P is a surface of the sheet P on which a toner image is formed. In two-sided printing, immediately after a toner image is formed on a first side of a sheet P, the printed surface is the first side, and after a toner image is formed on a second side of the sheet P, the printed surface is the second side.

<Configuration of Separating Unit>

Figure 4:
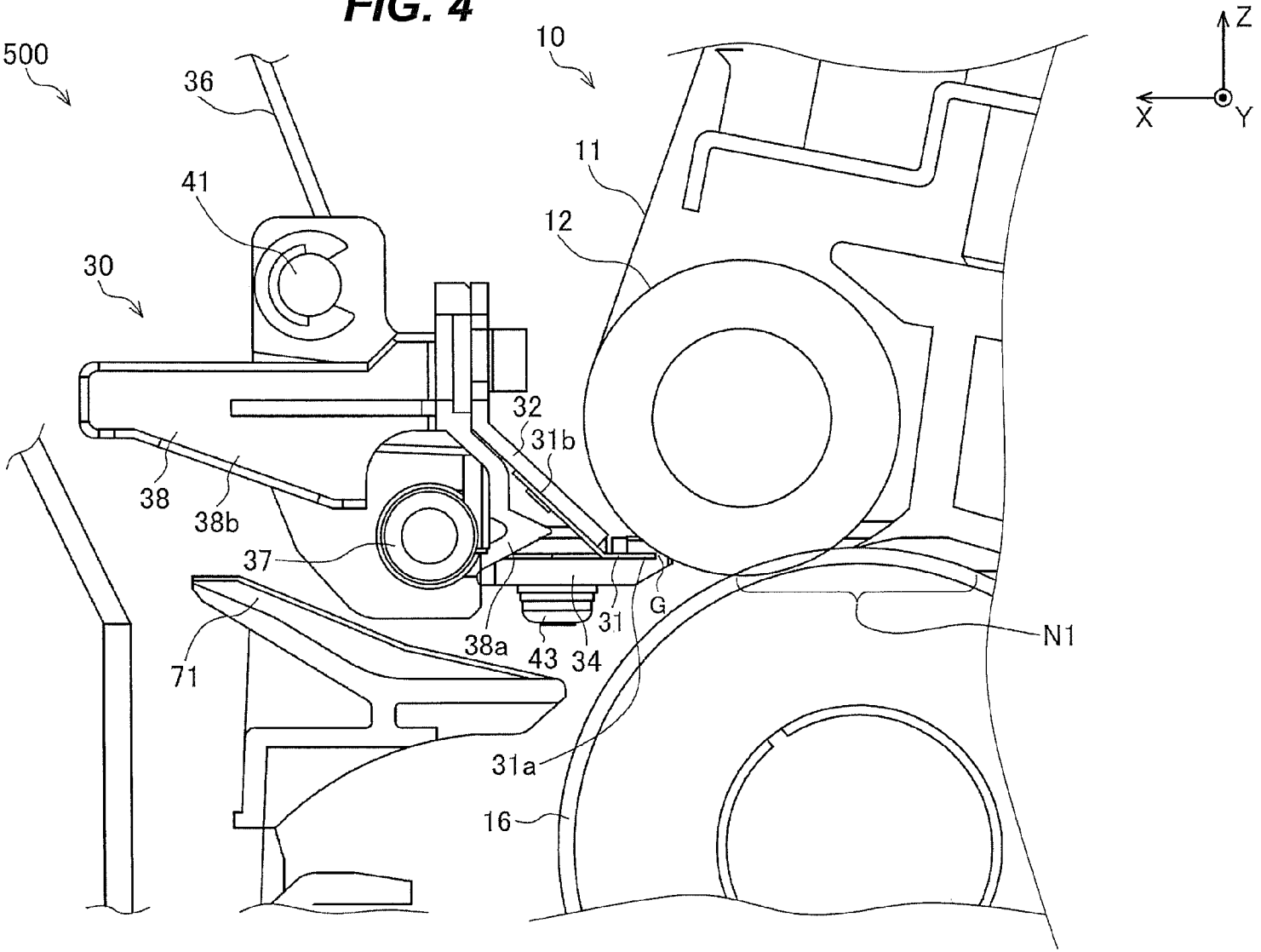
FIG. 4 is a sectional view of a separating unit and its periphery.
Figure 5:
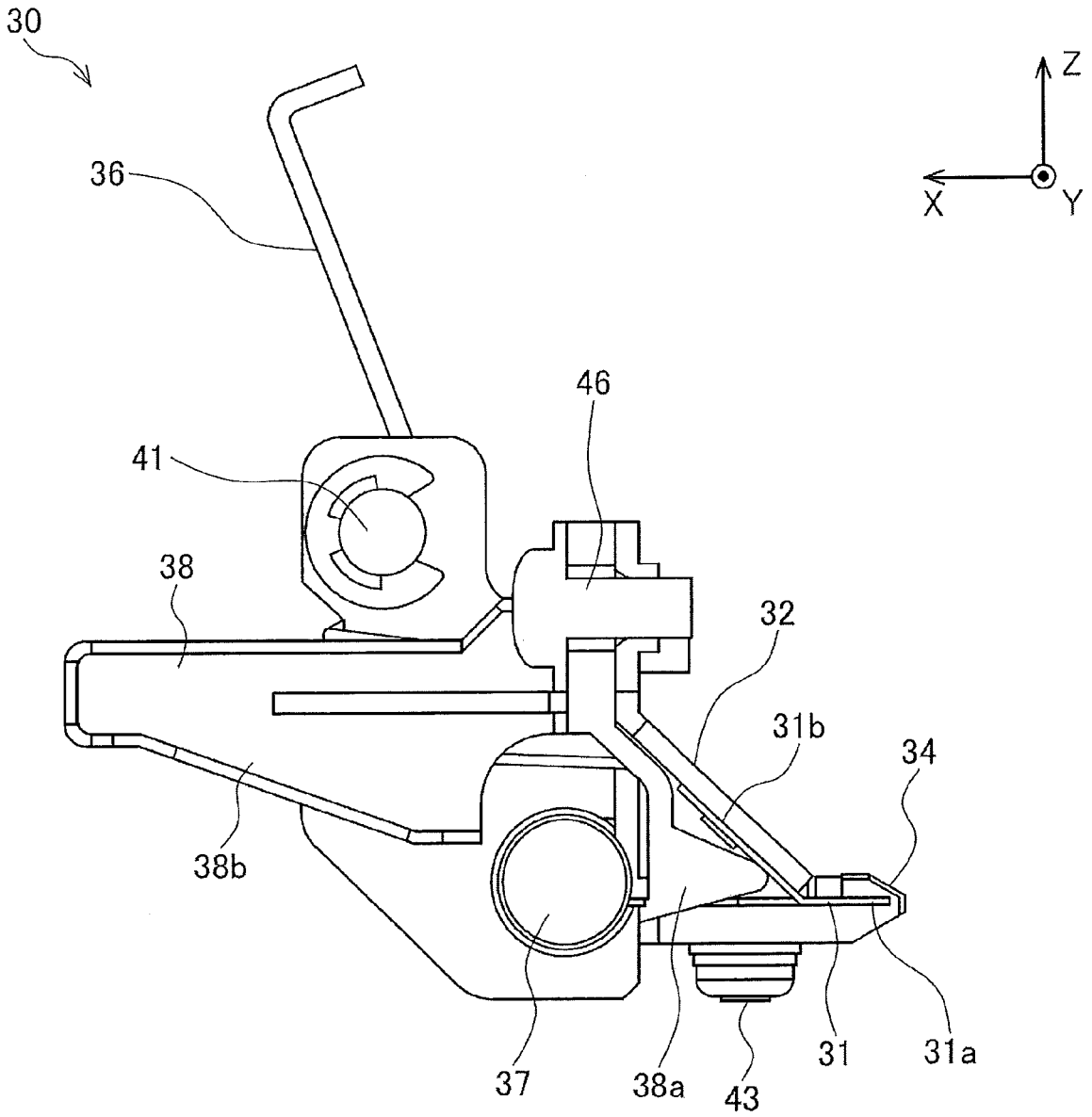
FIG. 5 is a sectional view of the separating unit.
Figure 6:
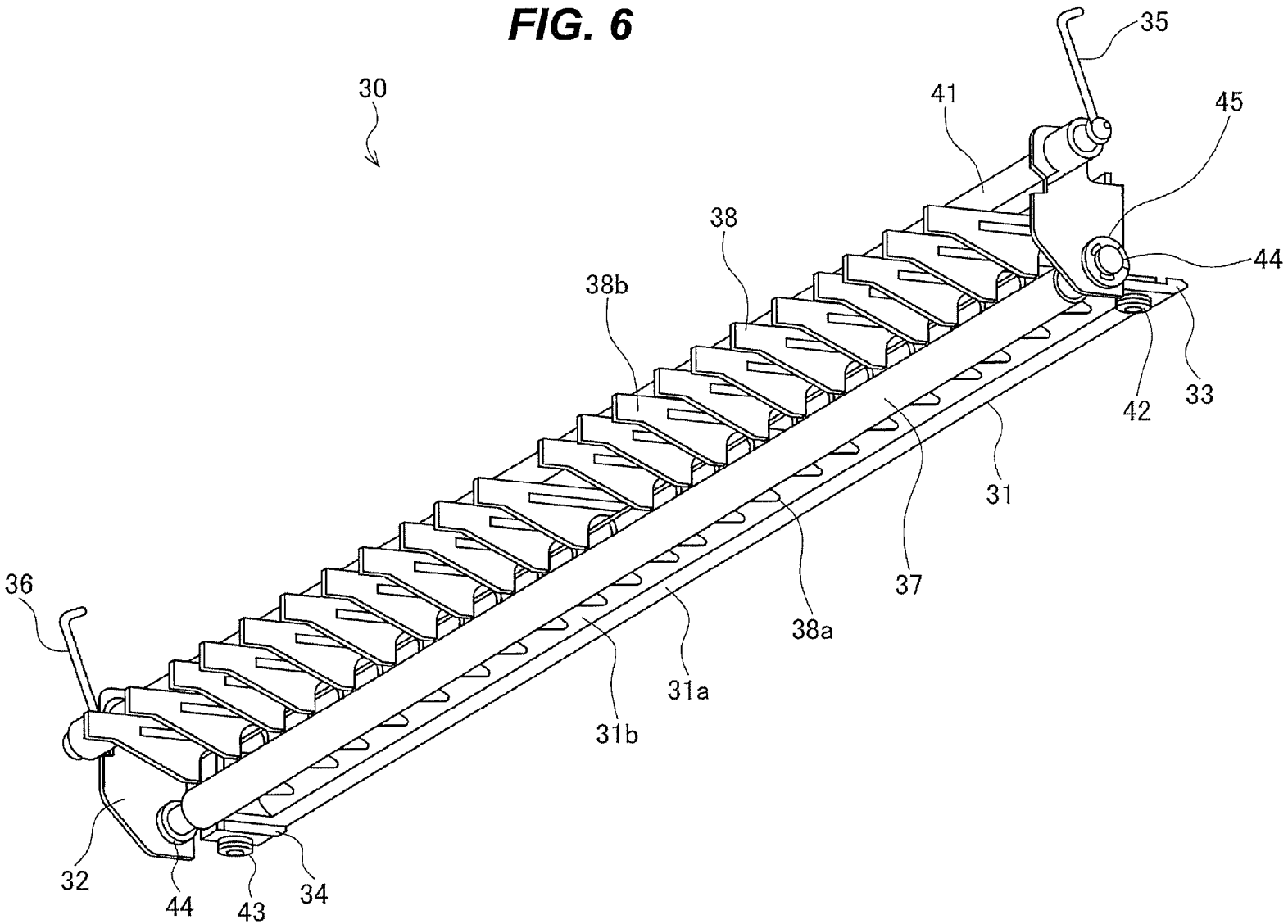
FIG. 6 is a perspective view of the separating unit.

FIG. 4 is a sectional view of the separating unit 30 and its periphery. FIG. 5 is a sectional view of the separating unit 30. FIG. 6 is a perspective view of the separating unit 30. The configuration of the separating unit 30 will be described below with reference to FIGS. 4 to 6.

The separating unit 30 includes a separating plate 31 as a separating member, a holder 32, abutting members (or spacers) 33 and 34, springs 35 and 36 as urging members, a guide roller 37, and a sheet guide 38.

The separating plate 31 is a member for separating, from the fixing belt 11, the sheet P discharged from the nip portion N1. The separating plate 31 is disposed downstream of the nip portion N1 in the sheet conveying direction facing or close to the fixing belt 11. The separating plate 31 is a plate-shaped member. From the view point of preventing dew condensation, the thickness of the separating plate 31 is preferably thin, and specifically preferably 0.5 mm or less. The separating plate 31 is, for example, formed by processing one metal sheet. Here, the separating plate 31 is formed of a stainless steel sheet with a thickness of 0.3 mm.

The separating plate 31 has a separating guide portion 31*a* for separating, from the fixing belt 11, the sheet P discharged from the nip portion N1, and an extending portion 31*b* extending from a downstream edge in the sheet conveying direction of the separating guide portion 31*a*. These will be detailed later.

The holder 32 holds the separating plate 31. Specifically, the holder 32 holds the extending portion 31*b* of the separating plate 31. The holder 32 is a plate-shaped member that extends in the width direction and has a greater thickness than the separating plate 31. The holder 32 is formed of the same material as the separating plate 31 so as to have the same thermal expansion rate as the separating plate 31. The holder 32 is, for example, formed by processing one metal sheet. Here, the holder 32 is formed of a stainless steel sheet with a thickness of 1.0 mm. The separating plate 31 is fixed to the holder 32 by spot welding, for example. The holder 32 is supported rotatably about an axis of rotation extending in the width direction with respect to the fixing frame 21. Specifically, the holder 32 is rotatably mounted to a shaft 41 that is fixed to the fixing frame 21 and extends in the width direction.

The abutting members 33 and 34 are mounted to the separating plate 31, and abut against the fixing belt 11 so as to form a constant gap G between the separating plate 31 (specifically, the separating guide portion 31*a*) and the fixing belt 11. The gap G is, for example, from 0.2 to 0.5 mm. The abutting members 33 and 34 are formed of resin having good slidability. The abutting members 33 and 34 are mounted to both ends of the separating plate 31 in the width direction. Specifically, in the width direction, the abutting members 33 and 34 are arranged on both outer sides of an area (referred to below as 'the maximum sheet passing area') in which the widest sheet that can be conveyed by the fixing device 500 (or can be used in the image forming apparatus 1) is conveyed. The abutting members 33 and 34 are fixed to the holder 32 while being positioned by the separating plate 31. Here, the abutting members 33 and 34 are screwed to the holder 32 by means of external threads (or screws) 42 and 43, respectively.

The springs 35 and 36 urge the holder 32 in a direction in which the abutting members 33 and 34 abut against the fixing belt 11. Specifically, the springs 35 and 36 are torsion springs each having a coil portion disposed around the shaft 41, one arm engaged with and held by the holder 32, and another arm engaged with and held by the fixing frame 21. The urging force of the springs 35 and 36 causes the abutting members 33 and 34 to abut against the fixing roller 12 via the fixing belt 11, so that the separating plate 31 is disposed with the constant gap G between the separating plate 31 and the fixing belt 11.

The guide roller 37 is disposed downstream of the separating plate 31 (specifically, the separating guide portion 31*a*) in the sheet conveying direction, and guides the sheet P discharged from the fixing unit 10 while rotating along the sheet conveying direction. The guide roller 37 extends over the maximum sheet passing area in the width direction. The length of the guide roller 37 in the width direction is greater than the width of the maximum sheet passing area. The guide roller 37 is disposed near the separating plate 31. The guide roller 37 is disposed to project toward the sheet P (or the sheet conveying path 80) relative to a surface (specifically, a lower surface 31*h* of the separating guide portion 31*a*, described later) of the separating plate 31 that makes contact with the sheet P. The guide roller 37 is disposed to make contact with the printed surface of the sheet P.

The guide roller 37 is configured to rotate along with the sheet P when the sheet P is conveyed. The guide roller 37 is rotated by friction with the sheet P. Specifically, the guide roller 37 is rotatably supported by the holder 32 about an axis of rotation extending in the width direction. More specifically, the guide roller 37 is supported at both ends of the holder 32 in the width direction via bearings 44. E-rings 45 are attached to both ends of the guide roller 37 outside the holder 32 in the width direction. The E-rings 45 restrict movement of the guide roller 37 in the width direction to prevent the guide roller 37 from dropping out of the holder 32.

The sheet guide 38 extends in the sheet conveying direction and guides the sheet P discharged from the fixing unit 10. The sheet guide 38 is fixed to the holder 32. Specifically, the sheet guide 38 is screwed to the holder 32 by means of an external thread (or a screw) 46. The sheet guide 38 has an upstream guide 38*a* and a downstream guide 38*b*. The upstream guide 38*a* is disposed downstream of the separating guide portion 31*a* and upstream of the guide roller 37 in the sheet conveying direction so as to face the extending portion 31*b* The upstream guide 38*a* is a guide member for guiding the sheet P. The upstream guide 38*a* is disposed to prevent the sheet P from making contact with the extending portion 31*b*. The downstream guide 38*b* is disposed downstream of the guide roller 37 in the sheet conveying direction, and guides the sheet P. Each of the upstream guide 38*a* and downstream guide 38*b* has multiple ribs that are arranged in the width direction and extend in the sheet conveying direction so as to reduce a contact area with the sheet P.

Figure 7:
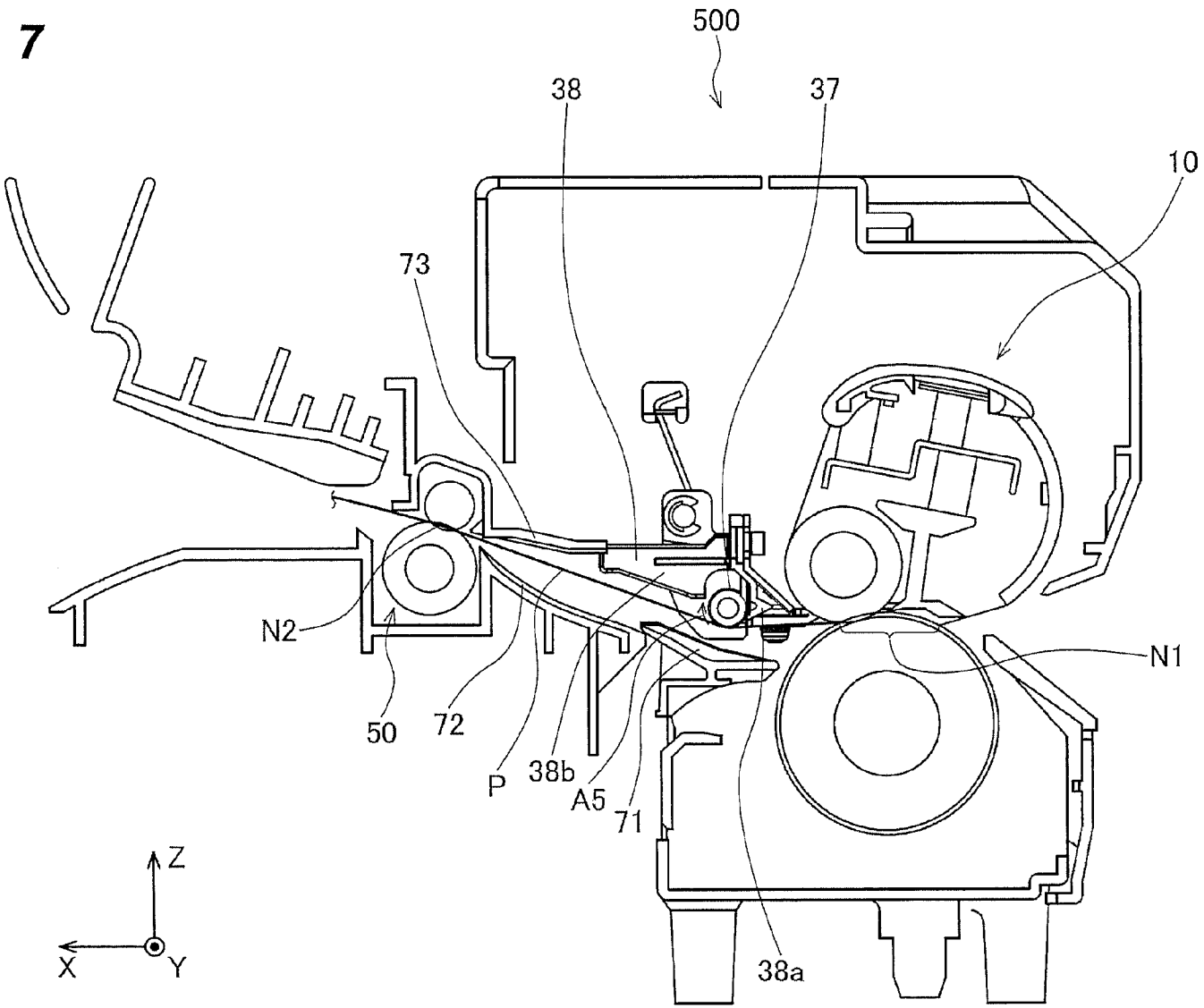
FIG. 7 illustrates a situation where a sheet of paper is conveyed in the fixing device.

FIG. 7 illustrates a situation where a sheet P is conveyed in the fixing device 500.

As illustrated in FIG. 7, the guide roller 37 is disposed to make contact with the sheet P when the sheet P is stretched taut between the fixing unit 10 and the pair of conveying rollers 50. Specifically, when viewed from the width direction, the guide roller 37 is disposed to project toward the sheet conveying path 80 relative to a straight line connecting an exit (a downstream end in the sheet conveying direction) of the nip portion N1 of the fixing unit 10 and an entrance (an upstream end in the sheet conveying direction) of the nip portion N2 of the pair of conveying rollers 50.

The sheet guide 38 is disposed so as not to make contact with the sheet P when the sheet P is stretched taut between the fixing unit 10 and the pair of conveying rollers 50. Specifically, when viewed from the width direction, the upstream guide 38*a* is disposed so as not to project toward the sheet conveying path 80 relative to a straight line that passes through the exit of the nip portion N1 of the fixing unit 10 and is tangent to the outer periphery of the guide roller 37. When viewed from the width direction, the downstream guide 38*b* is disposed so as not to project toward the sheet conveying path 80 relative to a straight line that passes through the entrance of the nip portion N2 of the pair of conveying rollers 50 and is tangent to the outer periphery of the guide roller 37.

Further, the sheet guides 71 to 73 are disposed so as not to make contact with the sheet P when the sheet P is stretched taut between the fixing unit 10 and the pair of conveying rollers 50. Specifically, when viewed from the width direction, the sheet guide 73 is disposed so as not to project toward the sheet conveying path 80 relative to the straight line that passes through the entrance of the nip portion N2 of the pair of conveying rollers 50 and is tangent to the outer periphery of the guide roller 37.

The fixing device 500 is configured so that the sheet P makes contact with only the guide roller 37 between the fixing unit 10 and the pair of conveying rollers 50 when the sheet P is stretched taut between the fixing unit 10 and the pair of conveying rollers 50.

The configuration of the separating unit 30 will be described in more detail below.

(Configuration of Separating Plate)

Figure 8:
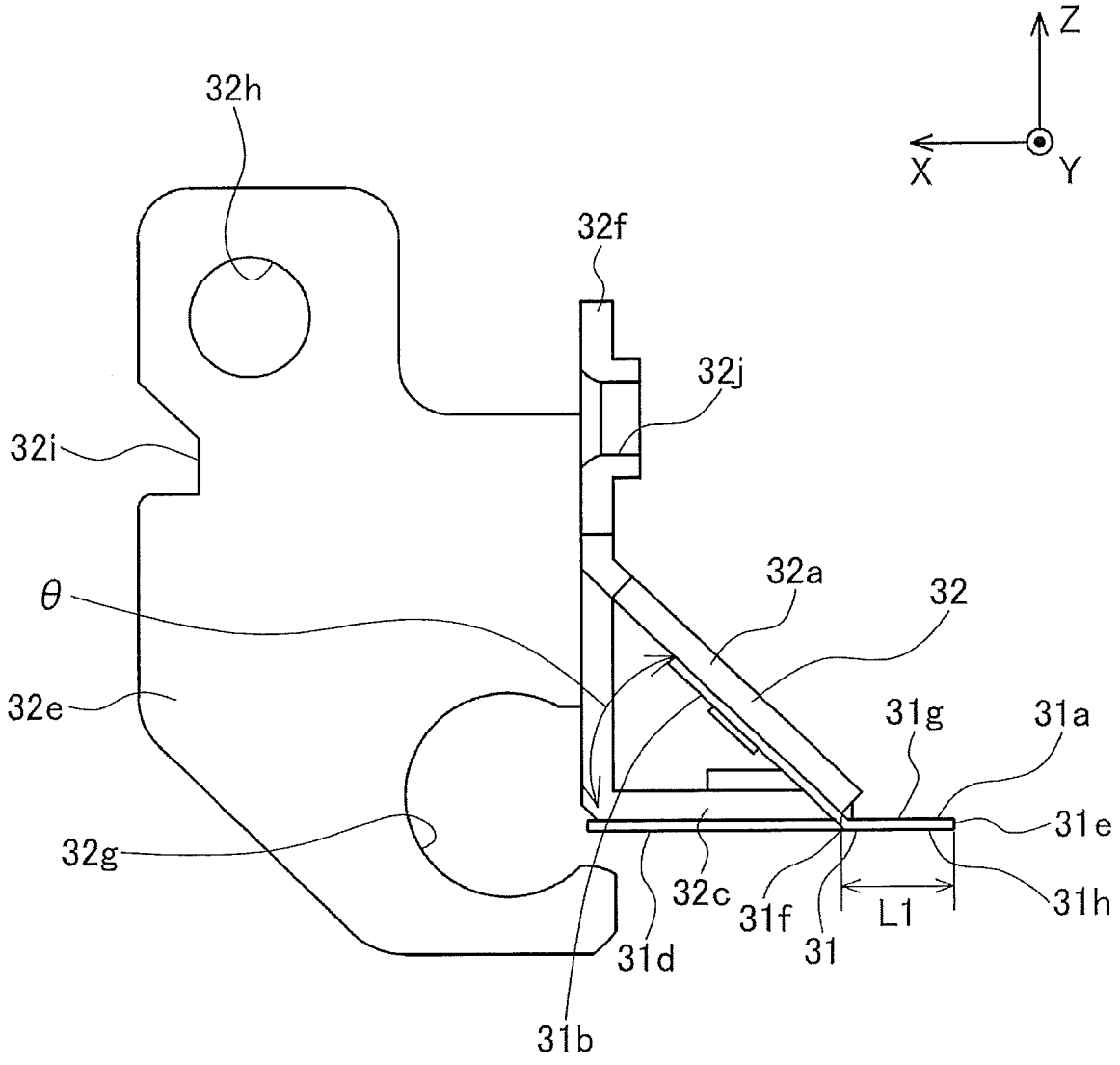
FIG. 8 is a sectional view of a separating plate and a holder.
Figure 9:
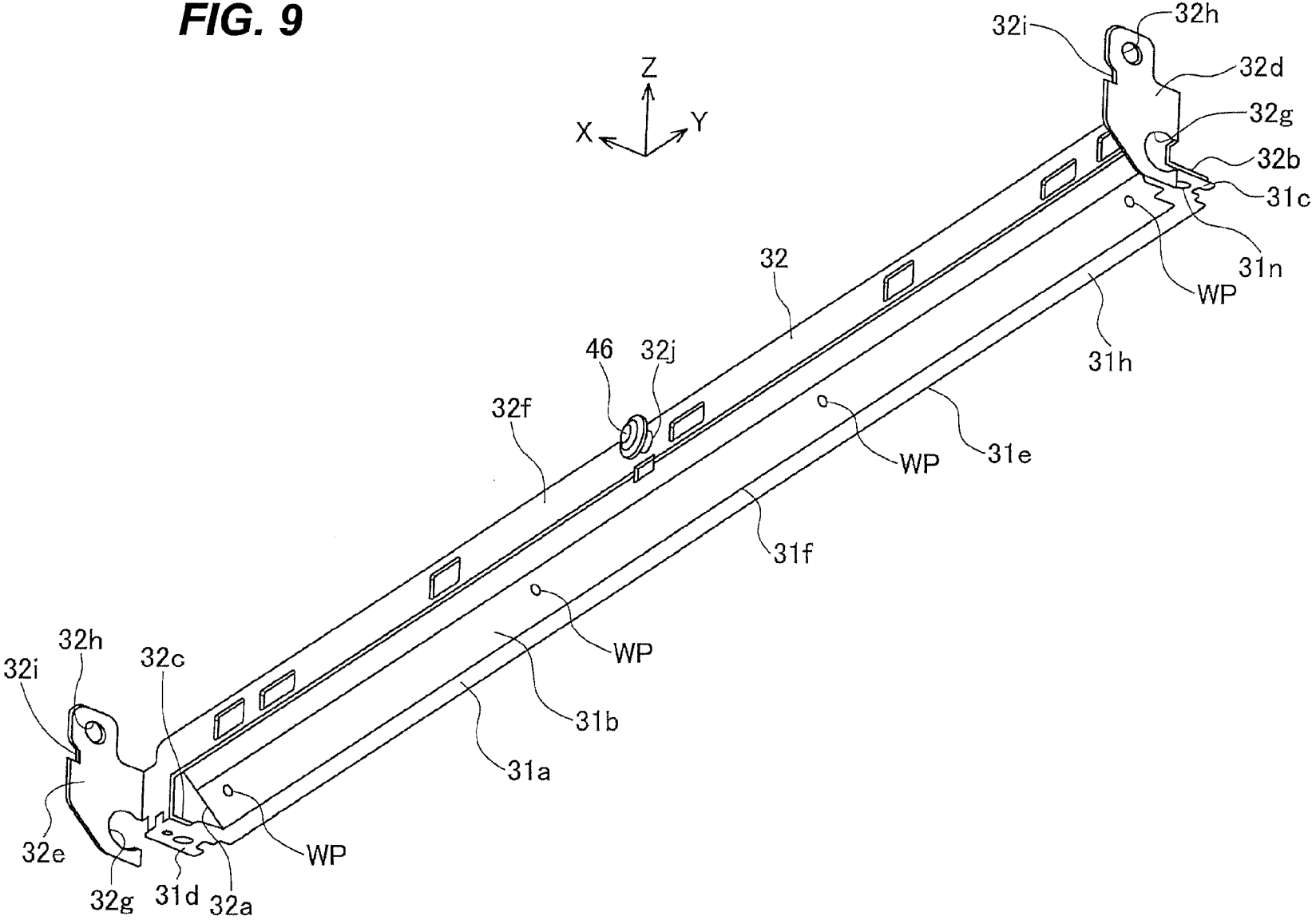
FIG. 9 is a perspective view of the separating plate and holder.

FIG. 8 is a sectional view of the separating plate 31 and holder 32 taken along a plane perpendicular to the width direction. FIG. 9 is a perspective view of the separating plate 31 and holder 32. The configuration of the separating plate 31 will be described with reference mainly to FIGS. 8 and 9.

The separating plate 31 has the separating guide portion 31*a* for separating, from the fixing belt 11, the sheet P discharged from the nip portion N1 and guiding it, the extending portion 31*b* extending from the separating guide portion 31*a*, and mounted portions 31*c* and 31*d* to which the abutting members 33 and 34 are mounted.

The separating guide portion 31*a* is disposed along the width direction downstream of the nip portion N1 in the sheet conveying direction so as to face or be close to the fixing belt 11. The separating guide portion 31*a* has an elongated shape extending in the width direction, and extends over the maximum sheet passing area in the width direction. The length of the separating guide portion 31*a* in the width direction is greater than the width of the maximum sheet passing area.

The separating guide portion 31*a* extends in a guide direction (the left-right direction on the drawing sheet of FIG. 8) along the sheet conveying direction. From the view point of preventing dew condensation, the length L1 of the separating guide portion 31*a* in the guide direction is preferably small, specifically preferably 5 mm or less, and here 4 mm.

The separating guide portion 31*a* has a front edge portion 31*e* that is an upstream edge portion in the sheet conveying direction and a rear edge portion 31*f* that is a downstream edge portion in the sheet conveying direction. The front edge portion 31*e* and rear edge portion 31*f* extend parallel to each other in the width direction.

The separating guide portion 31*a* also has an upper surface 31*g* and the lower surface 31*h*. The upper surface 31*g* and lower surface 31*h* are surfaces extending in both the guide direction and the width direction, and oppose each other in a thickness direction of the separating guide portion 31*a* (the direction perpendicular to both the guide direction and the width direction, or the upper-lower direction on the drawing sheet of FIG. 8). The lower surface 31*h* has a fluorine coating thereon.

Hereinafter, for convenience of explanation, as indicated by arrows X, Y, and Z in FIGS. 8 and 9, a direction parallel to the guide direction will be referred to as 'the X direction'; a direction parallel to the width direction will be referred to as 'the Y direction'; a direction perpendicular to both the X and Y directions (the thickness direction of the separating guide portion 31*a*) will be referred to as 'the Z direction'. The Z direction matches a vertical direction or an upper-lower direction of the fixing device 500, for example. In the X direction, the direction corresponding to the sheet conveying direction will be referred to as 'the +X direction'; the opposite direction will be referred to as 'the −X direction. In the Y direction, when the fixing device 500 is viewed from the +X direction side, the rightward direction (the front side of the drawing sheet of FIG. 8) will be referred to as 'the +Y direction'; the opposite direction will be referred to as 'the −Y direction'. In the Z direction, the direction from the sheet conveying path 80 toward the separating guide portion 31*a* will be referred to as 'the +Z direction'; the opposite direction will be referred to as 'the −Z direction'. Similarly to FIGS. 8 and 9, FIGS. 1, 3, 4, 5, 7, 10, and 11 also show arrows indicating the X, Y, and Z directions.

The extending portion 31*b* extends from the rear edge portion 31*f* of the separating guide portion 31*a*. The extending portion 31*b* is bent (or inclined) with respect to the separating guide portion 31*a* (or the guide direction) so as to separate from the sheet P (or a plane including the lower surface 31*h*) as it extends downstream in the sheet conveying direction. That is, the separating plate 31 is bent in a direction away from the sheet P, at its downstream part in the sheet conveying direction The angle θ by which the separating plate 31 is bent (or by which the extending portion 31*b* is inclined with respect to the separating guide portion 31*a*) is preferably 30° or greater, and here 45°. Thus, the separating plate 31 is bent by 45° in a direction away from the sheet conveying path 80, at a position 4 mm away from the front edge portion 31*e* in the +X direction. In this example, the separating plate 31 is bent sharply, but it may be curved.

The extending portion 31*b* has an elongated shape extending in the Y direction, and extends over the entire length of the separating guide portion 31*a* in the Y direction. The term 'the entire length' is intended to include not only the entire length in a strict sense but also substantially the entire length.

The mounted portions 31*c* and 31*d* are disposed on outer sides (the +Y direction side and −Y direction side, respectively) of the separating guide portion 31*a* in the Y direction. The mounted portions 31*c* and 31*d* will be detailed later.

<Configuration of Holder>

The configuration of the holder 32 will now be described with reference mainly to FIGS. 8 and 9.

The holder 32 has a separating plate holding portion 32*a* that holds the separating plate 31. The extending portion 31*b* is in contact with and fixed to the separating plate holding portion 32*a*. The separating plate holding portion 32*a* is in contact with a back surface of the extending portion 31*b* opposite the sheet conveying path 80. The separating plate holding portion 32*a* is in contact with the extending portion 31*b* over the entire length of the extending portion 31*b* in the Y direction. Specifically, the separating plate holding portion 32*a* is in contact with the whole of the back surface of the extending portion 31*b*. The terms 'the entire length' and 'the whole' are intended to include not only the entire length and the whole in a strict sense but also substantially the entire length and substantially the whole, respectively. The extending portion 31*b* is fixed to the separating plate holding portion 32*a* by spot welding at multiple welding points WP along the Y direction.

In addition, the holder 32 has abutting member holding portions 32*b* and 32*c* that hold the abutting members 33 and 34, guide roller supporting portions 32*d* and 32*e* that support the guide roller 37, and a sheet guide holding portion 32*f* that holds the sheet guide 38.

The abutting member holding portions 32*b* and 32*c* are disposed on outer sides (the +Y direction side and −Y direction side, respectively) of the separating plate holding portion 32*a* in the Y direction. The abutting member holding portions 32*b* and 32*c* will be detailed later.

The guide roller supporting portions 32*d* and 32*e* are disposed on outer sides (+Y direction side and −Y direction side, respectively) of the separating plate holding portion 32*a* in the Y direction. Each of the guide roller supporting portions 32*d* and 32*e* has a bearing holding portion 32*g* that holds one of the bearings 44, an insertion hole 32*h* through which the shaft 41 is inserted, and an engaging portion 32*i* that engages with and holds the arm of the spring 35 or 36.

The sheet guide holding portion 32*f* is disposed on the +z direction side of the separating plate holding portion 32*a*, and has an internal thread (or a screw hole) 32*j* that mates with the external thread 46.

<Structure for Positioning Abutting Member>

Figure 10:
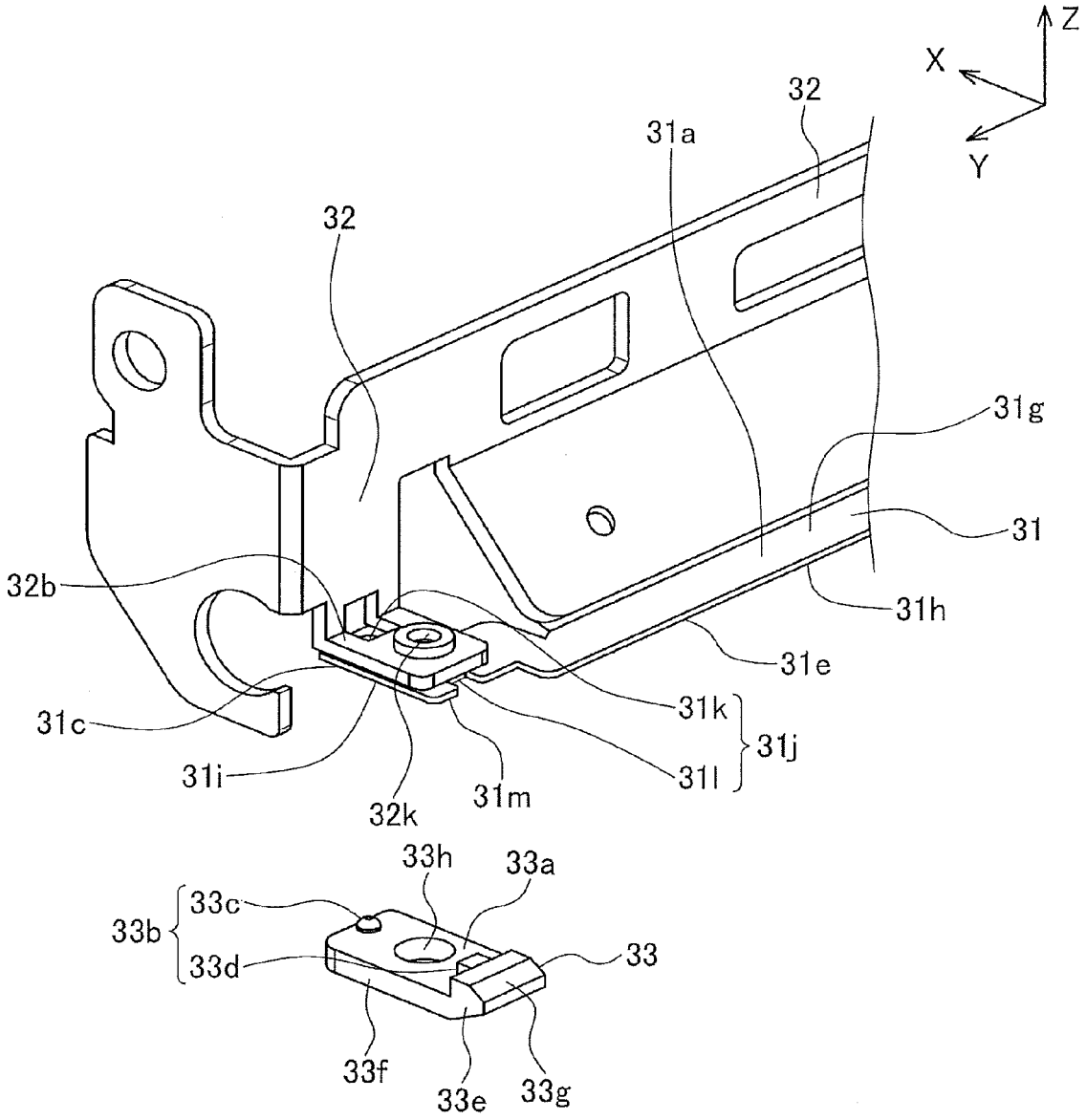
FIG. 10 is a perspective view illustrating a state before mounting of an abutting member.
Figure 11:
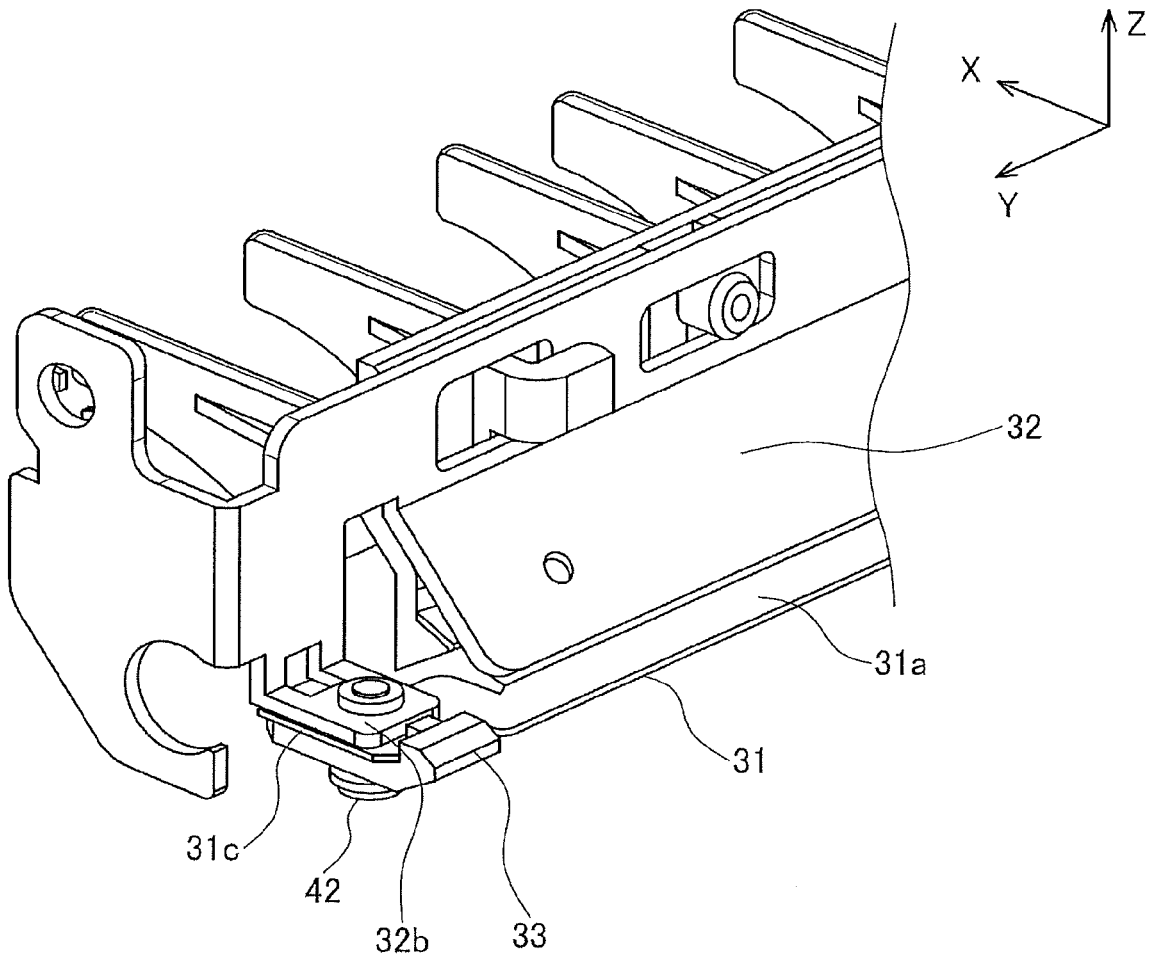
FIG. 11 is a perspective view illustrating a state after mounting of the abutting member.

FIG. 10 is a perspective view illustrating a state before mounting of the abutting member 33; FIG. 11 is a perspective view illustrating a state after mounting of the abutting member 33. A structure for positioning the abutting member 33 will be described with reference mainly to FIGS. 10 and 11.

The mounted portion 31*c* of the separating plate 31 has a mounted surface 31*i* to which the abutting member 33 is mounted. The mounted surface 31*i* is flush with the lower surface 31*h* of the separating guide portion 31*a*. Specifically, the mounted portion 31*c* is formed to extend in the +Y direction from the separating guide portion 31*a*. The mounted portion 31*c* has an upper surface flush with the upper surface 31*g* of the separating guide portion 31*a* and the lower surface (the mounted surface) 31*i* flush with the lower surface 31*h* of the separating guide portion 31*a*. The mounted surface 31*i* makes contact with a mounting surface 33*a* disposed on the abutting member 33.

The abutting member 33 has an engaging portion 33*b*, and the mounted portion 31*c* has an engaged portion 31*j*. The engaged portion 31*j* is engaged with the engaging portion 33*b*, thereby positioning the abutting member 33 with respect to the separating plate 31 in the X direction. Specifically, the engaged portion 31*j* is disposed in the mounted surface 31*i*, and the engaging portion 33*b* is disposed on the mounting surface 33*a*. More specifically, two engagement holes 31*k* and 31*l* are disposed in the mounted surface 31*i*. The engagement holes 31*k* and 31*l* pass through the mounted portion 31*c* in the Z direction, and are arranged at a predetermined interval in the X direction. Two engagement projections 33*c* and 33*d* are disposed on the mounting surface 33*a*. The engagement projections 33*c* and 33*d* are fitted in the engagement holes 31*k* and 31*l*, so that the abutting member 33 is positioned with respect to the separating plate 31 in the X and Y directions. It is sufficient that the engaged portion 31*j* and engaging portion 33*b* can position the abutting member 33, and it is also possible that the engaged portion 31*j* has only one engagement hole and the engaging portion 33*b* has only one engagement projection.

The mounted portion 31*c* is disposed farther from the fixing belt 11 than the separating guide portion 31*a*, and has a front edge portion 31*m* on the −X direction side. The front edge portion 31*m* is formed away from the front edge portion 31*e* of the separating guide portion 31*a* in the +X direction. On the other hand, the abutting member 33 has an abutting piece 33*e* that abuts against the fixing belt 11, and a supporting piece 33*f* that supports the abutting piece 33*e*. The supporting piece 33*f* has the mounting surface 33*a*, and faces the mounted surface 31*i*. The abutting piece 33*e* is formed to project from the supporting piece 33*f* in the −X direction and project from the −Z direction side to the +Z direction side of the mounted portion 31*c*. The abutting piece 33*e* is sandwiched between the front edge portion 31*m* of the mounted portion 31*c* and the fixing belt 11. The abutting piece 33*e* has, at its front edge on the −X direction side, an abutting surface 33*g* that abuts against the fixing belt 11.

<Structure for Fixing Abutting Member>

A structure for fixing the abutting member 33 will now be described with reference mainly to FIGS. 10 and 11.

The abutting member holding portion 32*b* of the holder 32 is disposed to face the mounted portion 31*c* of the separating plate 31 in the Z direction. Here, the abutting member holding portion 32*b* is disposed on the +Z direction side of the mounted portion 31*c*. The abutting member holding portion 32*b* has an internal thread (or a screw hole) 32*k* extending in the Z direction.

The mounted portion 31*c* has, at a position corresponding to the internal thread 32*k*, a through-hole 31*n* passing through the mounted portion 31*c* in the Z direction (see FIG. 9). The through-hole 31*n* is formed between the two engagement holes 31*k* and 31*l*. The engagement holes 31*k* and 31*l* and the through-hole 31*n* are arranged in a line in the X direction.

The abutting member 33 has, at a position corresponding to the internal thread 32*k*, a through-hole 33*h* passing through the abutting member 33 in the Z direction. The through-hole 33*h* is formed between the two engagement projections 33*c* and 33*d*. The engagement projections 33*c* and 33*d* and the through-hole 33*h* are arranged in a line in the X direction.

The external thread 42 passes through the through-hole 33*h* of the abutting member 33 and the through-hole 31*n* of the mounted portion 31*c*, and is screwed into the internal thread 32*k* of the holder 32. Thereby, the abutting member 33 is fixed to the holder 32.

A positioning structure and a fixing structure for the abutting member 34 are the same as those for the abutting member 33, and thus their description will be omitted.

<Configuration of Guide Roller>

Figure 12A:
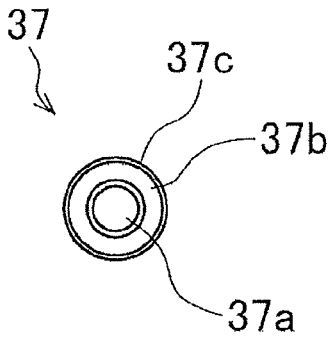
FIGS. 12(*a*) and 12(*b*) are, respectively, a side view and a sectional view of a guide roller.
Figure 12B:
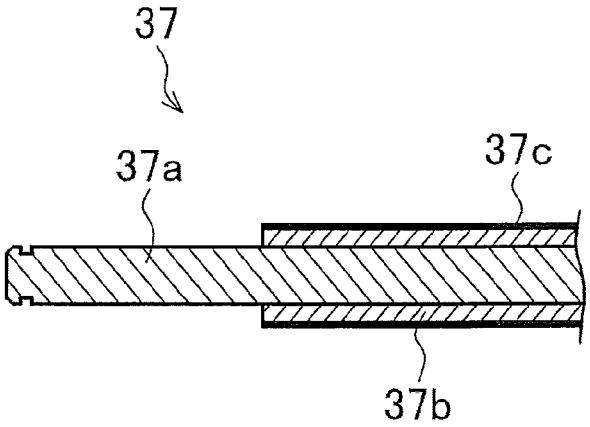

FIGS. 12(*a*) and 12(*b*) are a side view and a sectional view of the guide roller 37, respectively. The configuration of the guide roller 37 will be described below with reference to FIGS. 12(*a*) and 12(*b*).

The guide roller 37 has a shaft 37*a* that is disposed rotatably and extends in the width direction. If the shaft 37*a* bends, the guide roller 37 may produce its desired effect insufficiently. Thus, the shaft 37*a* preferably has high rigidity, and is preferably made of metal. Here, the shaft 37*a* is made of free-cutting steel (SUM 24L) and has a diameter of 4 mm.

A heat-insulating layer 37*b* is disposed on an outer periphery of the shaft 37*a*. The heat-insulating layer 37*b* has a lower heat conductivity than the shaft 37*a*. The heat-insulating layer 37*b* is preferably formed of foam (or sponge), and more preferably heat-resistant foam. Here, melamine resin foam is used since it has high heat insulating properties and high heat resistance. The thickness of the heat-insulating layer 37*b* is preferably 1 mm or greater, for example, from 1 mm to 2 mm, and here 1.5 mm. The heat-insulating layer 37*b* is bonded to the shaft 37*a* with adhesive agent.

A release layer 37*c* is disposed on an outer periphery of the heat-insulating layer 37*b*. The release layer 37*c* has higher releasability to toner than the heat-insulating layer 37*b*. Preferably, the release layer 37*c* is formed of a fluorine-based material (specifically, fluorine resin). Here, the release layer 37*c* is a tube made of a fluorine-based material, and specifically, a PFA (tetra fluoro ethylene-perfluoro alkylvinyl ether copolymer) tube having heat-shrinkable properties. The PFA tube is heat-contracted to cover a surface of the heat-insulating layer 37*b*.

The larger the number of air spaces (or bubbles) in the foam, the lower the heat conductivity of the foam, the more easily the surface temperature of the guide roller 37 rises, and the higher the effect against dew condensation. Thus, the lower the density of the foam, the higher the effect against dew condensation. The density mentioned here is a value obtained by dividing the mass of the foam by the volume of the foam (the sum of the volume of the resin and the volume of the bubbles) in a mounted state (for example, a state in which the foam is disposed between the shaft and the PFA tube).

In an experiment that was conducted using an image forming apparatus of this embodiment, the use of a melamine sponge with a density of 0.015 g/cm$^3$ was sufficiently effective against dew condensation. The use of a silicone sponge with a density of 1.14 g/cm$^3$ was less effective than the use of the melamine sponge, but effective compared to no heat-insulating layer. The density of the above melamine sponge in a free state was 0.010 g/cm$^3$, and the density of the above silicone sponge in a free state was 1.0 g/cm$^3$. The density in a free state mentioned here is a value obtained by dividing the mass of a foam by the volume of the foam in a state before the foam is set in a guide roller.

<Operation of Image Forming Apparatus>

The operation of the image forming apparatus 1 will be described below.

When the control unit 801 receives a print command from a host device (not illustrated), it controls respective units of the image forming apparatus 1 so that the following printing operation is performed.

Referring to FIG. 1, the sheets P stored in the sheet tray 100 are fed out one by one by the sheet feeding section 200, and conveyed to the transfer belt 421 by the sheet conveying section 300. Meanwhile, each of the toner image forming units 401K, 410Y, 410M, and 410C forms a toner image on the photosensitive drum 411. The toner images of the respective colors formed on the respective photosensitive drums 411 are sequentially transferred by the transfer unit 420 onto the sheet P on the transfer belt 421 in a superposed manner. The sheet P onto which the toner image has been transferred is conveyed while being sandwiched at the nip portion N1 of the fixing device 500. At this time, the toner image is heated and pressed to be fixed onto the sheet P. The sheet P after the fixing is conveyed and discharged to the stacker 604 by the pair of conveying rollers 50 and the pairs of discharge rollers 601 and 602.

Referring to FIGS. 2 and 3, in the fixing device 500, when the printing operation is started, the power supply unit 803 starts power supply to the heating member 13, which heats the fixing belt 11. The driving unit 802 starts to drive the fixing roller 12 to rotate, and in conjunction with this, the fixing belt 11 and pressure roller 16 rotate. The control unit 801 controls the electric power supplied to the heating member 13 on the basis of the temperature detected by the temperature detecting member 25 so that the temperature of the fixing belt 11 becomes a predetermined temperature. The control unit 801 also controls the conveyance of the sheet P on the basis of the temperature detected by the temperature detecting member 25 so that the sheet P reaches the nip portion N1 after the temperature of the fixing belt 11 reaches a temperature at which a toner image can be fixed.

Referring to FIGS. 3 and 4, when the sheet P passes through the nip portion N1, if it adheres to the fixing belt 11, it is separated from the fixing belt 11 by the separating plate 31 and conveyed. Specifically, the sheet P is separated by the separating guide portion 31*a* and moves in contact with the lower surface 31*h* of the separating guide portion 31*a*. Then, the sheet P moves while being guided by the sheet guides 38 and 71 to 73 and the guide roller 37, and reaches the pair of conveying rollers 50. At this time, the sheet P makes no contact with the extending portion 31*b* of the separating plate 31.

Since the sheet conveying velocity VE of the pair of conveying rollers 50 is greater than the sheet conveying velocity VF of the fixing unit 10, the pair of conveying rollers 50 conveys the sheet P while pulling it. Thus, as illustrated in FIG. 7, the sheet P is conveyed while being stretched taut between the pair of conveying rollers 50 and the fixing unit 10. At this time, the sheet P makes contact with the guide roller 37, which rotates in the direction indicated by arrow A5 in FIG. 7 along with the movement of the sheet P by frictional force from the sheet P.

In the printing operation, the fixing unit 10 heats the sheet P, which generates water vapor. This may cause dew condensation on parts of the fixing device 500 with low surface temperature.

In this embodiment, since the separating guide portion 31*a* is near the fixing belt 11, is thin and short, and has a small heat capacity, the temperature of the separating guide portion 31*a* rises rapidly due to heat from the fixing belt 11. Therefore, no dew condensation occurs on the separating guide portion 31*a* (i.e., a part of the separating plate 31 with which the sheet P makes contact). On the other hand, since the extending portion 31*b* is in contact with the holder 32, which has a large heat capacity, the extending portion 31*b* tends not to rise in temperature and tends to cause dew condensation in comparison with the separating guide portion 31*a*. However, since the sheet P makes no contact with the extending portion 31*b*, if dew condensation occurs on the extending portion 31*b*, the dew condensation water on the extending portion 31*b* does not make contact with the sheet P and thus does not wet the sheet P.

Since the guide roller 37 has the heat-insulating layer 37*b* between the shaft 37*a* and the release layer (surface layer) 37*c*, the surface temperature of the guide roller 37 rises rapidly due to heat from the fixing belt 11. This prevents the occurrence of dew condensation on the guide roller 37.

Since the sheet guide 38 has the ribs and the contact area between the sheet guide 38 and the sheet P is small, if dew condensation occurs on the sheet guide 38, the dew condensation water is not likely to adhere to the sheet P, or slightly adheres to it.

<Advantages>

The following advantages (1) to (11) can be obtained from this embodiment described above.

(1) A downstream portion of the separating plate 31 in the sheet conveying direction is bent (or inclined) in a direction away from the sheet P. This configuration makes it possible to prevent the sheet P from being wetted due to dew condensation on the separating plate 31. Specifically, compared to a case where a separating plate that is not bent is used, it is possible to narrow an area of the separating plate that makes contact with the sheet, thereby preventing adhesion of dew condensation water on the separating plate 31 to the sheet P. More specifically, since an upstream portion of the separating plate 31 is close to the fixing belt 11, it tends to warm up and tends not to cause dew condensation. Compared to the upstream portion, since the downstream portion of the separating plate 31 is far from the fixing belt 11, it tends not to warm up and tends to cause dew condensation. However, since the downstream portion is bent (or inclined) in the direction away from the sheet P, dew condensation water on the downstream portion is not likely to adhere to the sheet P. Further, by bending the separating plate 31, it is possible to enhance the rigidity of the separating plate 31. This makes it possible to thin the separating plate 31 and reduce its heat capacity, thereby preventing the occurrence of dew condensation. As a result, it is possible to obtain a high-quality print, and for example, to obtain a high-quality image while speeding up printing.

(2) The downstream portion (the extending portion 31*b*) of the separating plate 31 is in contact with and fixed to the holder 32. This configuration makes it possible to more effectively prevent the sheet P from being wetted due to dew condensation on the separating plate 31. Specifically, since the upstream portion of the separating plate 31 is not in contact with the holder 32, the occurrence of dew condensation on the upstream portion can be prevented. On the other hand, since the downstream portion of the separating plate 31 is in contact with the holder 32, it tends to cause dew condensation. However, since the downstream portion is bent in a direction away from the sheet P, dew condensation water on the downstream portion can be prevented from adhering to the sheet P.

(3) The holder 32 has a greater thickness than the separating plate 31. This configuration makes it possible to prevent, by the holder 32, deformation such as deflection of the separating plate 31, and thin the separating plate 31.

(4) The extending portion 31*b* extends over the entire length of the separating guide portion 31*a* in the width direction, and the holder 32 is in contact with the extending portion 31*b* over the entire length of the extending portion 31*b* in the width direction. This configuration makes it possible to successfully prevent deformation such as deflection of the separating plate 31.

(5) The mounted portion 31*c* has the mounted surface 31*i* flush with the lower surface 31*h* of the separating guide portion 31*a*, and the abutting member 33 has the mounting surface 33*a* that abuts on the mounted surface 31*i*. This configuration makes it possible to accurately position the abutting member 33 and accurately form the gap G, with a simple configuration. Specifically, it is possible to easily and accurately position the abutting member 33 with respect to the separating plate 31 in the Z direction. Further, the mounting surface 33*a* is provided with the engaging portion 33*b*, and the mounted surface 31*i* is provided with the engaged portion 31*j* that is engaged with the engaging portion 33*b*. This makes it possible to easily and accurately position the abutting member 33 with respect to the separating plate 31 in the X direction.

(6) The abutting member 33 is fixed to the holder 32 while being positioned by the mounted portion 31*c*. In this configuration, since the abutting member 33 is fixed to the holder 32, there is no need to thicken the separating plate 31 in order to fix the abutting member 33.

(7) The guide roller 37 is disposed to project toward the sheet P relative to a surface of the separating plate 31 that makes contact with the sheet P (specifically, the lower surface 31*h*). With this configuration, it is possible to guide the sheet P by the guide roller 37 so that the sheet P is separated from the separating plate 31 (specifically, the lower surface 31*h*). This makes it possible to reduce contact between the sheet P and the separating plate 31, preventing adhesion of toner from the sheet P to the separating plate 31 and adhesion of toner from the separating plate 31 to the sheet P.

(8) The guide roller 37 extends over the maximum sheet passing area in the width direction. This configuration makes it possible to prevent an image defect due to the guide roller 37. Specifically, a guide roller having a small dimension in the width direction and making contact with only a part of a sheet may cause an image defect. For example, such a guide roller may make a mark on a printed image. Specifically, toner may be peeled off from a sheet by an edge of the guide roller, or the peeled-off toner may adhere to another sheet, which may cause a streak on the printed image. Further, a difference in gloss may occur on a printed image between a part that makes contact with the guide roller and the other part. In contrast, the above configuration in this embodiment makes it possible to avoid the above problems due to contact of a guide roller with a part of a sheet.

(9) The guide roller 37 has, on its surface, the release layer 37*c*. This makes it possible to prevent adhesion of toner from the sheet P to the guide roller 37.

(10) The guide roller 37 has the heat-insulating layer 37*b* disposed on the outer periphery of the shaft 37*a*. This makes it possible to reduce heat transfer between the surface of the guide roller 37 and the shaft 37*a*, preventing dew condensation on the guide roller 37.

(11) The fixing device 500 is configured so that when the sheet P is stretched taut between the fixing unit 10 and the pair of conveying rollers 50, the sheet P makes contact with only the guide roller 37 between the fixing unit 10 and the pair of conveying rollers 50. This configuration makes it possible to prevent deterioration of a toner image due to friction between the sheet P and the sheet guides or the like when the sheet P is conveyed while being stretched taut.

In this specification, the term 'parallel' is intended to include not only parallel in a strict sense but also substantially parallel.

The present invention is not limited to the embodiment described above; it can be practiced in various other aspects without departing from the invention scope.

For example, the guide roller 37 may be modified as described in the following items (a) to (h), and these modifications may be combined appropriately.

(a) The heat-insulating layer 37*b* is not limited to a foam body; it may be formed of, for example, a solid resin material. For example, if the heat capacity or heat conductivity of the shaft 37*a* is sufficiently small, or if the thickness of the heat-insulating layer 37*b* is sufficiently large, a solid material can be used.

(b) The release layer 37*c* is not limited to a fluorine resin tube; it may be formed by fluorine resin coating.

(c) The heat-insulating layer 37*b* may be omitted and the release layer 37*c* may be disposed directly on the surface of the shaft 37*a*. For example, if the heat capacity or heat conductivity of the shaft 37*a* is sufficiently small, the heat-insulating layer 37*b* can be omitted.

(d) The release layer 37*c* may be omitted and the heat-insulating layer 37*b* may be disposed on the surface of the shaft 37*a* as a surface layer (or a top layer). For example, if the releasability of the heat-insulating layer 37*b* is sufficiently high, the release layer 37*c* can be omitted.

(e) Both the heat-insulating layer 37*b* and the release layer 37*c* may be omitted and the guide roller 37 may consist of only the shaft 37*a*. For example, if the heat capacity or heat conductivity of the shaft 37*a* is sufficiently small and the releasability of the shaft 37*a* is sufficiently high, both the heat-insulating layer 37*b* and the release layer 37*c* can be omitted.

(f) The shaft 37*a* may have an air space or layer therein. This makes it possible to reduce the heat capacity or heat conductivity of the shaft 37*a*. For example, a hollow cylinder-shaped member may be used as the shaft 37*a*.

Figure 13:
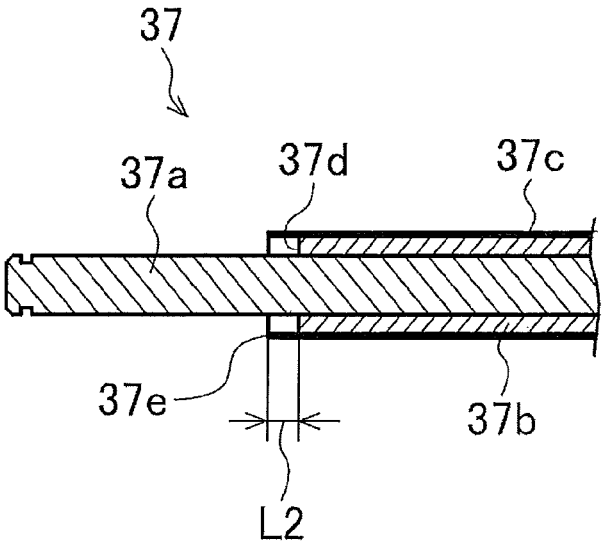
FIG. 13 illustrates a modification of the guide roller.

(g) The guide roller 37 may be configured so that in the width direction, at least one end of the heat-insulating layer 37*b* is positioned inside the corresponding end of the release layer 37*c*. In the example of FIG. 13, in the width direction, the length of the heat-insulating layer (or the foam) 37*b* is less than that of the release layer (or the PFA tube) 37*c*, and an end 37*d* of the heat-insulating layer 37*b* is displaced by a distance L2 (e.g., 2 mm) inward from an end 37*e* of the release layer 37*c*. This configuration makes it possible to prevent the heat-insulating layer (or the foam) 37*b* from projecting outside the release layer (or the PFA tube) 37*c* due to heat expansion.

(h) The guide roller 37 may be driven to rotate by a driving force from the driving unit 802. In this case, the guide roller 37 is driven so that a velocity of movement of a surface of the guide roller 37 is the same as a velocity of movement of the sheet P.

In addition, it is sufficient that the guide roller 37 is disposed between the fixing unit 10 and the pair of conveying rollers 50; the guide roller 37 may be disposed in a place other than the separating unit 30. Further, the guide roller 37 or the separating unit 30 may be omitted.

Although the above embodiment illustrates a color printer, the present invention is applicable to other types of image forming apparatus such as a monochrome printer, a copier, a facsimile machine, or a multifunction peripheral (MFP).

What is claimed is:

1. A fixing device, comprising:

a fixing unit that includes a rotating fixing member and a pressure member that makes contact with the fixing member to form a nip portion between the fixing member and the pressure member, and that heats a recording medium on which a toner image is formed while conveying the recording medium with the recording medium nipped in the nip portion, thereby fixing the toner image to the recording medium;

a plate-shaped separating member that separates, from the fixing member, the recording medium discharged from the nip portion, the separating member including:

a separating guide portion that is disposed downstream of the nip portion in a conveying direction in which the recording medium is conveyed in such a manner as to face the fixing member along a width direction of the fixing member perpendicular to the conveying direction, that extends along the conveying direction, and that separates the recording medium from the fixing member and guides the recording medium;

a first extending portion that extends from a downstream edge of the separating guide portion in the conveying direction, and is bent with respect to the separating guide portion in such a manner as to separate from the recording medium as it extends downstream in the conveying direction; and a second extending portion that extends from the separating guide portion in the width direction flush with the separating guide portion, and extends downstream of the separating guide portion in the conveying direction in such a manner as to be adjacent to the first extending portion in the width direction;

an abutting member that is disposed on the second extending portion and that abuts against the fixing member to form a gap between the separating guide portion and the fixing member; and a holder that holds the first extending portion and the second extending portion.

2. The fixing device of claim 1, wherein the first extending portion is in contact with and fixed to the holder.

3. The fixing device of claim 1, wherein the holder is a plate-shaped member having a thickness that is greater than that of the separating member.

4. The fixing device of claim 1, wherein in the width direction, the separating guide portion extends over an area in which a widest recording medium that can be conveyed by the fixing device is conveyed.

5. The fixing device of claim 1, wherein the first extending portion extends over an entire length of the separating guide portion in the width direction, and wherein the holder is in contact with the first extending portion over an entire length of the first extending portion in the width direction.

6. The fixing device of claim 1, wherein the abutting member is mounted to the second extending portion and abuts against the fixing member to form a constant gap between the separating guide portion and the fixing member.

7. The fixing device of claim 1, wherein the separating guide portion has a surface that extends in both a guide direction along the conveying direction and the width direction, wherein the second extending portion has a surface flush with the surface of the separating guide portion, and wherein the abutting member has a surface that makes contact with the surface of the second extending portion.

8. The fixing device of claim 1, wherein the abutting member has an engaging portion, and wherein the second extending portion has an engaged portion that is engaged with the engaging portion to position the abutting member with respect to the separating member in a guide direction along the conveying direction.

9. he fixing device of claim 1, further comprising a guide member that is disposed downstream of the separating guide portion in the conveying direction so as to face the first extending portion, and that guides the recording medium.

10. The fixing device of claim 1, further comprising a guide roller that is disposed downstream of the separating guide portion in the conveying direction, and guides the recording medium discharged from the fixing unit while rotating along the conveying direction.

11. The fixing device of claim 10, wherein the guide roller is disposed to project toward the recording medium relative to a surface of the separating guide portion that makes contact with the recording medium.

12. The fixing device of claim 10, wherein the guide roller is rotatably supported by the holder.

13. The fixing device of claim 10, wherein in the width direction, the guide roller extends over an area in which a widest recording medium that can be conveyed by the fixing device is conveyed.

14. The fixing device of claim 10, wherein the guide roller includes a shaft that is rotatably disposed and extends in the width direction; a heat-insulating layer that is disposed on an outer periphery of the shaft and formed of foam; and a release layer disposed on an outer periphery of the heat-insulating layer.

15. The fixing device of claim 14, wherein the release layer is formed of fluorine resin.

16. An image forming apparatus comprising the fixing device of claim 1 and an image forming section that forms the toner image on the recording medium.

17. The fixing device of claim 1, wherein the holder has an abutting area having a leading edge that is located downstream of the downstream edge of the separating guide portion in the conveying direction, the abutting area being an area abutting the separating member within a length of the separating guide portion in the width direction, and the leading edge being an upstream edge in the conveying direction.

18. The fixing device of claim 1, wherein the holder does not abut the separating guide portion.

19. The fixing device of claim 1, wherein the second extending portion is sandwiched between the holder and the abutting member.

20. The fixing device of claim 1, wherein the first extending portion is inclined at an angle with respect to the separating guide portion, which angle is 30° or greater.

* * * * *